US005344109A

United States Patent [19]

Hokoana, Jr.

[11] Patent Number: 5,344,109

[45] Date of Patent: Sep. 6, 1994

[54] APPARATUS FOR THE ENGAGEMENT AND SUSPENSION OF A BAG ABOVE THE GROUND FOR THE SUSPENDABLE STORAGE OF ITEMS WITHIN THE BAG

[76] Inventor: Abel K. Hokoana, Jr., 2238 Kaluaopalena St. Apt. A-101, Honolulu, Hi. 96819

[21] Appl. No.: 29,007

[22] Filed: Mar. 10, 1993

[51] Int. Cl.[5] ..... B65B 67/04

[52] U.S. Cl. ..... 248/100; 248/339

[58] Field of Search ..... 248/100, 101, 99, 95, 248/322, 327, 317, 339; 220/404; 141/314, 391

[56] References Cited

U.S. PATENT DOCUMENTS

| | | | |
|---|---|---|---|
| 260,707 | 7/1882 | Pendleton | 248/100 |
| 678,684 | 7/1901 | Powell . | |
| 844,636 | 2/1907 | Vanderbilt, Jr. . | |
| 949,024 | 2/1910 | Mason . | |
| 1,286,940 | 12/1918 | Cerny | 248/95 |
| 1,340,714 | 5/1920 | Herrman | 248/99 |
| 2,078,438 | 4/1937 | Baxter . | |
| 2,530,456 | 11/1950 | Fracchia . | |
| 4,196,880 | 4/1980 | Hynes | 248/99 |
| 4,378,924 | 4/1983 | Christensen | 248/101 |
| 4,548,372 | 10/1985 | Lutzker . | |
| 4,765,579 | 8/1988 | Robbins, III et al. | 248/101 |
| 5,180,126 | 1/1993 | Bennett | 248/99 |

*Primary Examiner*—Ramon O. Ramirez

*Attorney, Agent, or Firm*—Nicholas J. Skarlatos

[57] ABSTRACT

The present invention provides an apparatus for suspending conventional trash bags and other bags above the ground for the storage and/or disposal of a variety of items ranging from lawn refuse to recyclable cans and bottles to camping supplies and food. The apparatus comprises a support frame for securing the rim of the bag thereto and suspension arms coupled to the support frame through the use of engagement hooks for hanging the bag above the ground. The support frame comprises a first aperture for insertion of the rim of the bag therethrough, the rim wrapped around the sides of the support frame such that the bag opens through the first aperture. To protect the items inside the bag from weather and animals, the apparatus further includes a cover frame with a second aperture disposed on top of the support frame and a lid for covering the second aperture. With this arrangement, the engagement hooks are used to engage and secure the corresponding corners of the support frame and the cover frame with the rim of the bag firmly secured therebetween. The apparatus may further include upholding means for coupling one end of the suspension arms together and engaging a support structure for suspension of the apparatus, the upholding means comprising one of a variety of attachment members and having a length adjustment member for facilitating attachment of the apparatus to an appropriate support structure.

20 Claims, 3 Drawing Sheets

APPARATUS FOR THE ENGAGEMENT AND SUSPENSION OF A BAG ABOVE THE GROUND FOR THE SUSPENDABLE STORAGE OF ITEMS WITHIN THE BAG

BACKGROUND OF THE INVENTION (1) Field of the Invention

The present invention relates to receptacles for the storage and/or disposal of trash or other items, and more particularly, to an apparatus for the engagement and suspension of bags above the ground.

(2) Prior Art

When cleaning up refuse, trash or other items around the home or yard, it is sometimes desirable to hang a bag above the ground for the storage and/or disposal of items within the bag for a variety of reasons. First, the bag may be placed in a more accessible location where the user can easily access the bag. For example, the bag may be suspended over a flower bed while the user removes the weeds from the flowers in order to avoid using a conventional trash can which cannot be set on the flowers. Similarly, the user need not constantly bend over to grab the bag and manipulate the rim of the bag about its opening in order to place the items in the bottom of the bag. Second, the bag can be held in a semi-open position through the use of a hook or other attachments which also support the bag above the ground. Another benefit to elevating bags above the ground is that it keeps the bag out of the reach of children, and especially animals, who enjoy meddling in and removing the contents of the bag in addition to tearing the bag open.

The normal mode of supporting a bag, such as a common trash bag, above the ground is to simply hang or tie a portion of bag's rim to a branch, a hook, a loop or the like so that the remaining (loose) portion of the rim hangs downward to place the bag is in a partially open position. However, there remains several disadvantages with this conventional technique. When a bag is hung from a sharp or pointed structure, the rim of the bag is likely to tear with the slightest force, spilling the contents of the bag over the ground. If the bag is to be hung as described, the bag should be attached to the structure at several points about its rim to prevent the weight from tearing the bag. However, it is normally difficult to find a structure having a plurality of appropriate protrusions for hanging the bag in this manner. Similarly, when attempting to tie the bag to a protrusion in the general work area, it is often difficult to find an appropriate protrusion at just the right height. Hence, since there exists no means for adjusting the height of a conventional trash bag off the ground, the bag is either too low to the ground to keep animals out (and prevent the user from bending over) or too high to permit easy access to the opening of the bag.

Furthermore, even when the bag is hung or tied to a protruding structure, the rim of the bag is not adequately supported for maintaining the bag in a truly open position. If the bag is attached to the structure at two points, only a narrow opening in the mouth of the bag can be formed due to the fact that the front and back rim portions of the bag are offset. Even so, the normally loose, front rim portion of the bag tends to flap back and forth to further inhibit the utility of the bag. Additionally, when a bag is hung outside for the collection of trash or lawn refuse around the yard, it must be taken down and put away after its use to prevent certain animals, such as birds or squirrels, from getting inside and tampering with the contents of the bag. Similarly, there is no cover or lid for the bag so that the bag must be removed and stored in a dry location during rainstorms to prevent water from filling the bag up, thereby ruining the contents of the bag or causing the bag to rip or fall due to the weight of the water.

Accordingly, it is an object of the present invention to provide an apparatus for suspending a bag above the ground for the storage and/or disposal of trash, recyclable material or other items in which a conventional trash bag can be utilized without the detriment of tearing the rim of the bag when hung from a support structure.

It is another object of the present invention to provide an apparatus for suspending a bag above the ground in addition to an upholding means for enabling the bag to be easily attached to a support structure and permitting adjustment of its height in order to place the bag in an appropriate location and keep the bag and its contents out of reach of animals and children.

It is a further object of the present invention to provide a hanging bag apparatus for the storage and/or disposal of trash, recyclable material or other items in which the rim or mouth of the bag is maintained in an open position through the use of a support frame to facilitate placement of the items into the bag.

It is yet another object of the present invention to provide a hanging bag apparatus in which a cover or lid is provided for covering the opening of the bag to protect the contents of the bag from the elements of weather and from tampering by animals.

It is still a further object of the present invention to provide a compact and lightweight hanging bag apparatus for use in camping where food and trash items can be stored far above the ground to prevent tampering by various animals and exposure of the contents to rain.

BRIEF SUMMARY OF THE INVENTION

To achieve the above-noted objects, the present invention provides an apparatus for suspending conventional trash bags and other bags above the ground for the storage and/or disposal of a variety of items. The apparatus comprises a support frame for securing a bag thereto and suspension arms coupled to the support frame through the use of engagement hooks for hanging the bag above the ground. The support frame comprises a top surface having a first aperture defined therein for passage of the bag's rim such that the bag opens through the first aperture. To protect the contents of the bag from animals and weather, a cover frame having a second aperture formed in its top surface and a lid adapted to close the second aperture are disposed on top of the support frame. When placed on top of the support frame, the cover frame acts as a clamping member to fasten the rim of the bag therebetween, with the rim preferably being wrapped around the sides of support frame.

The engagement hooks each comprise a central curvilinear portion with an upturned end (or prong) disposed on each side of the central portion, the upturned ends protruding from the same side of a plane defined by the central portion of the hook. With this construction, the engagement hooks are advantageously adapted to engage the corners of the support frame by means of the upturned ends of each hook grasping the adjacent sides of a corner such that the corner penetrates through the plane of the central portion for locking engagement by the hook. In this manner, a cover frame having a size and shape generally corresponding to the underlying support frame will be firmly secured thereto with the rim of the bag clamped therebetween.

To support the bag above the ground, the suspension arms include a first end with a loop or eyelet for attachment to the central portion of the engagement hooks and a second end with a similar loop for attachment to an upholding means. The upholding means comprises a structure such as a cord, a hook, a bracket or the like which acts as a mutual connection point between the various suspension arms and a natural support structure such as a tree, a beam, an overhang or a wall. Depending upon the use and placement of the apparatus, the upholding means may include a variety of attachment members and a length adjustment member for facilitating attachment of the apparatus to an appropriate support structure.

Although both the support frame and cover frame preferably comprise simple geometric shapes having a plurality of corners for attachment of the engagement hooks, the frames (and the second aperture) may take on plurality of sizes and shapes depending upon the specific use of the apparatus. Additionally, the suspension arms and the upholding means may comprise a variety of materials and structures for a variety of uses, and the upholding means need not be utilized at all when the suspension arms can be directly coupled to the support structure with ease.

BRIEF DESCRIPTION OF THE DRAWINGS

The objects, features and advantages of the present invention will become apparent from the following detailed description of the present invention in which.

DETAILED DESCRIPTION OF THE INVENTION

The present invention provides an apparatus for the suspendable storage of items within a bag having a support frame for securing the rim of the bag thereto and suspension arms coupled to the support frame through the use of engagement hooks for hanging the bag above the ground. In the following description, numerous details such as specific materials, structures, configurations and dimensions are set forth in order to provide a more complete understanding of the present invention. However, it is understood by those skilled in the art that the present invention can be practiced without these specific details. In other instances, well-known compositions, elements, structures, devices and the like are not set forth in detail in order to avoid unnecessarily obscuring the present invention.

Figure 1:
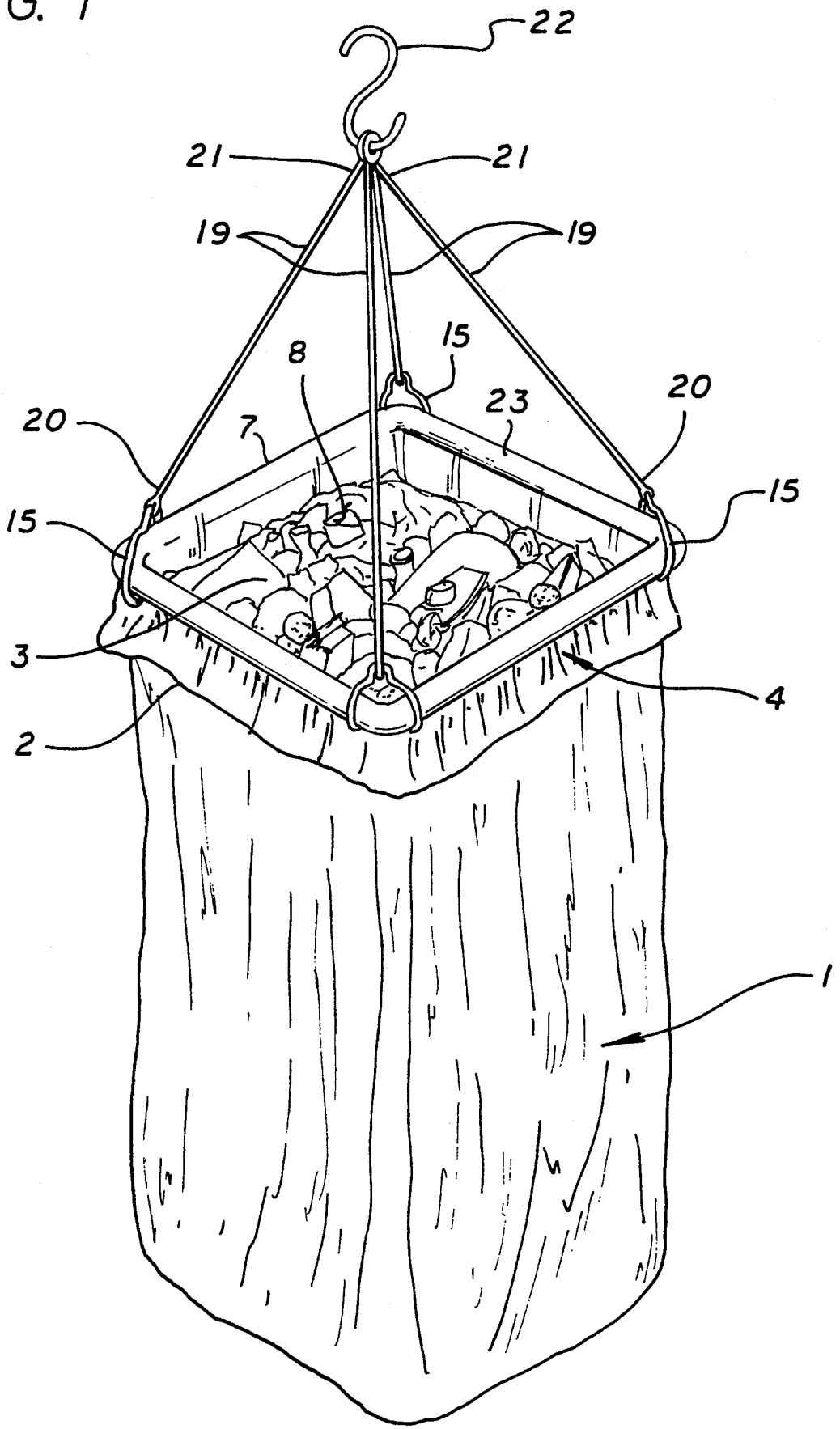
FIG. 1 is an elevated side view of the apparatus showing the use of the support frame without a cover frame for the collection of trash.
Figure 3:
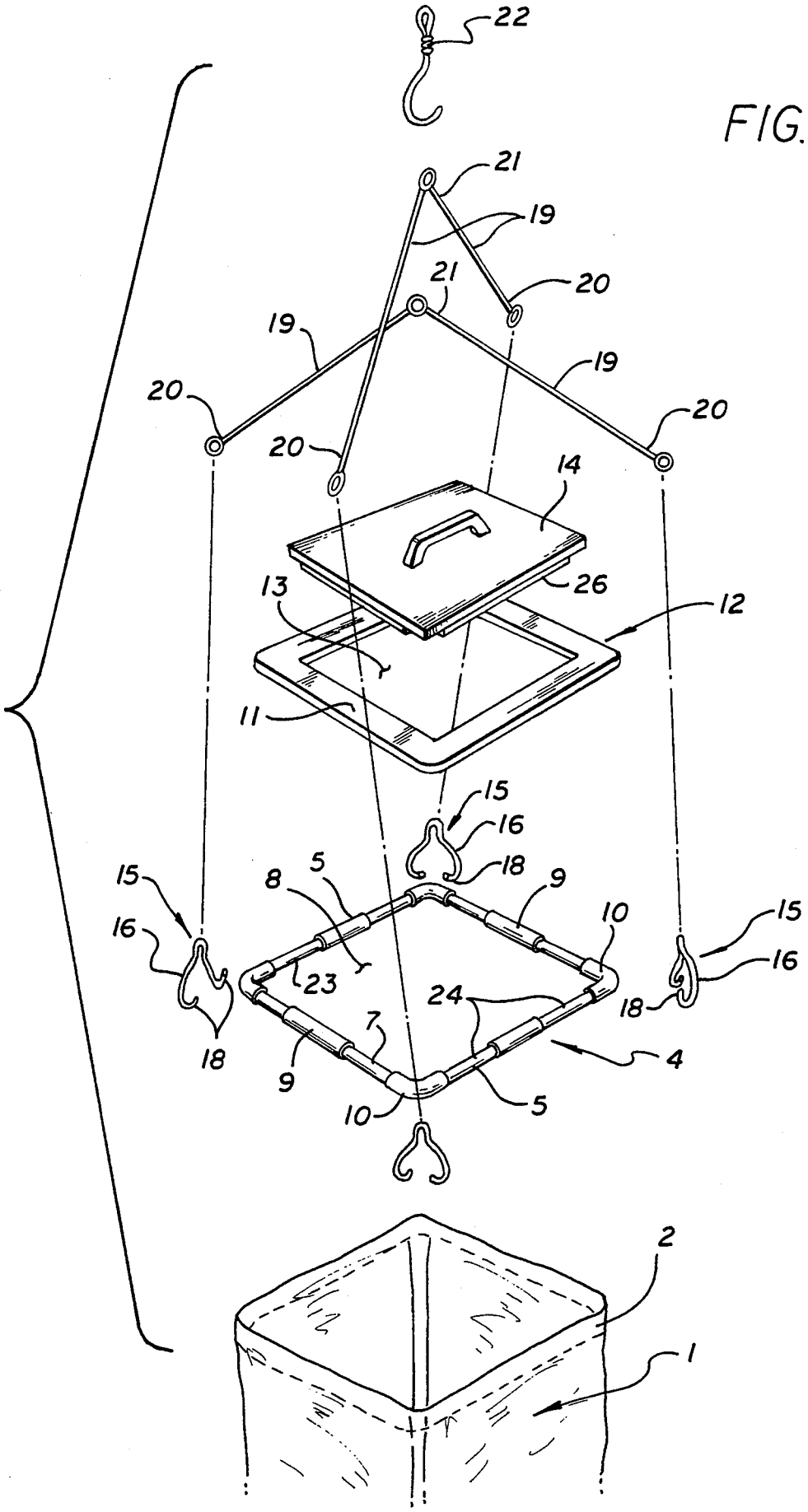
FIG. 3 is an exploded view the apparatus showing the use of a tubular support frame having telescopic joints for size adjustment in addition to a particular embodiment of the suspension arms.

The present invention is designed to provide a means for suspending conventional trash bags 1 and other bags 1 above the ground for the storage and/or disposal of a variety of items 3 ranging from lawn refuse to recyclable cans and bottles to camping supplies and food. The apparatus includes a support frame 4 which can be made in a variety of geometric and nongeometric shapes depending upon the purpose in mind and a variety of sizes depending upon the size of the specific bag 1 used. As shown in FIGS. 1 and 3, the support frame 4 preferably comprises a simple geometric shape having a top surface 7 with minimal surface area due to the formation of a first aperture 8 therein defined by an inner perimeter 23 of the support frame 4. The support frame 4 is preferably constructed from sturdy material such as plastic, metal, wood or the like. One mode of construction (not shown) is to mold the support frame 4 as a single piece out of plastic or hardened rubber. According to another mode of construction, shown in FIG. 3, the support frame 4 is constructed from PVC tubing wherein tubular side members 24 are coupled together by means of corner joints 10. The support frame 4 may also comprise telescopic joints 9 which, in the case of the embodiment shown in FIG. 3, take the form of two tubular side members 24 fitted within the passage of a third tubular member for increasing or reducing the size of the first aperture 8.

Figure 2:
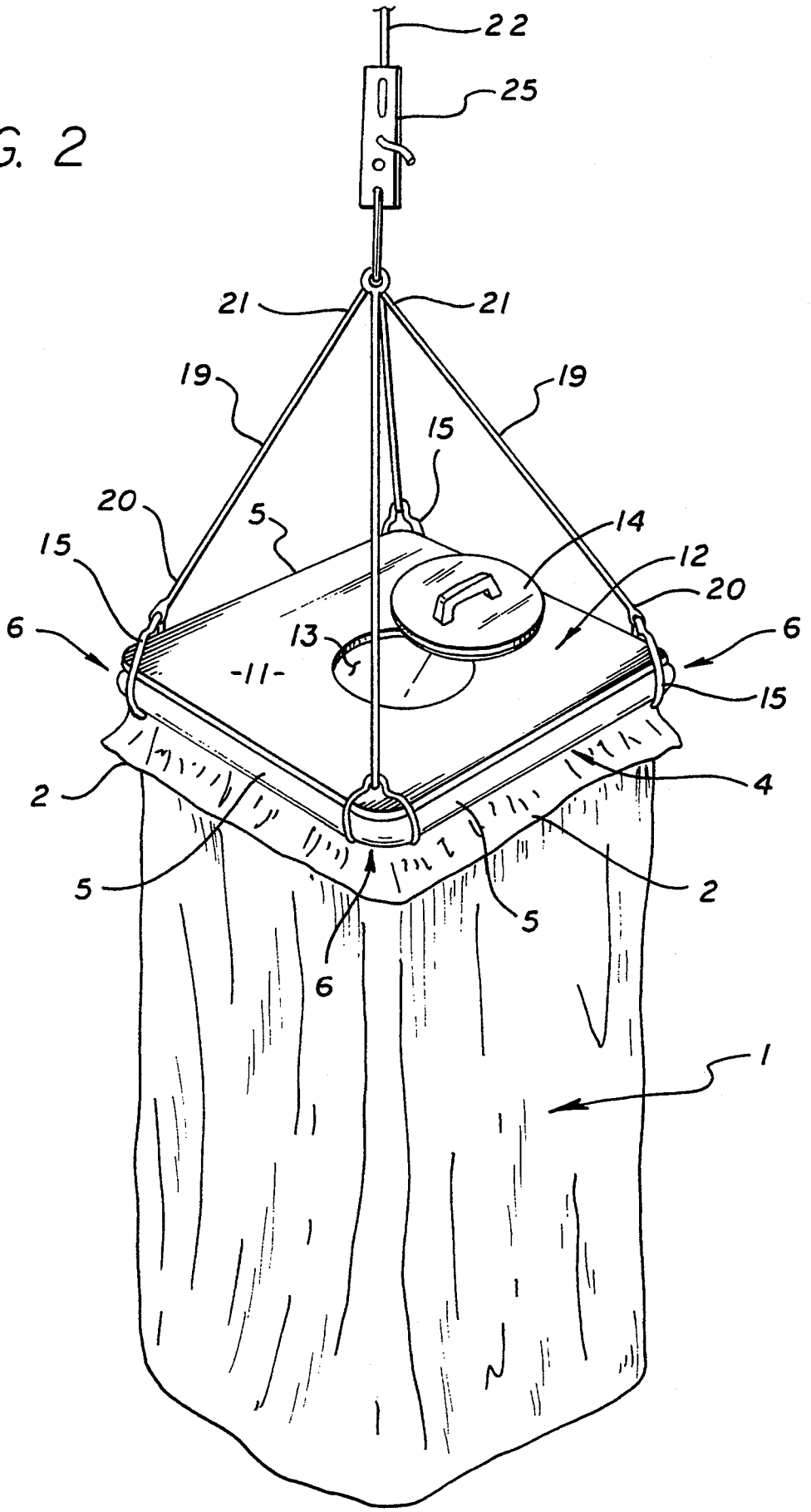
FIG. 2 is an elevated side view of the apparatus showing the use of a cover frame with its corners secured on top of the support frame through the use of engagement hooks, with the upholding means comprising a cord with a length adjustment member.

In order to secure the bag 1 in an open position, the rim 2 of the bag 1 is inserted through the first aperture 8 from beneath and placed over the top surface 7 of the support frame 4 on each side 5 so that the bag 1 opens through the first aperture 8. With this arrangement, the opening of the bag 1 is defined by the inner perimeter 23 of the support frame as shown in FIG. 1. However, as shown in FIGS. 2 and 3, the apparatus may further include a cover frame 11 having a planar surface 12 with a second aperture 13 formed therein for forming different size openings and providing a suitable means for covering the opening with a lid 14. The lid 14 generally has a surface area somewhat larger than the second aperture 13 so that it is supported by the cover frame 11 when positioned over the second aperture 13. In order to ensure the lid 14 is kept in place, downwardly protruding flanges 26 are provided on the bottom of the lid 14 for insertion into the second aperture 13 adjacent to the inside edges of the cover frame 11. Alternatively, the lid 14 may be pivotally affixed to the cover frame 11 through the use of hinges, a centrally disposed shaft or the like. The lid 14 further comprises a handle disposed on its top surface for ease in removing the lid 14.

With reference to FIGS. 2 and 3, the cover frame 11 generally has the same geometric shape and size of the support frame 4, although it can be constructed in different shapes and sizes for specific uses depending upon the top surface 7 of the support frame 4 and the first aperture 8 defined therein. To accommodate particular uses of the present invention, the second aperture 13 of the cover frame 11 can take the form of a circle for the collection of recyclable bottles and cans (as shown in FIG. 2) which construction would permit outside use while minimizing the exposure of the items 3. Similarly, the top surface 7 of the cover frame can be adapted with a protruding, hollow structure having a vertical face in which the second aperture is formed in the vertical face to simulate the lids of many conventional public trash cans.

As best shown in FIG. 3, the apparatus also includes engagement members such as hooks 15 for engaging the sides of the support frame 4 from underneath. The hooks 15 may be placed anywhere around the outside edges of the support frame 4, but must be evenly spaced so as not to tilt the support frame 4 when in a suspended state. Although conventional hooks can be utilized for the engagement members, the hooks 15 preferably comprise a central curvilinear portion 16 formed substantially within a plane and two upturned ends (or prongs) 18 disposed on opposite sides of the central portion 16 which extend outward on one side of the plane. The two upturned ends 16 of the hooks 15 are then secured underneath the sides 5 of the support frame 4 while the central portion 16 rests against the outer edge of the sides 5.

With this configuration, the hooks 15 can be advantageously engaged to the support frame 4 about its corners 6 to prevent the hooks 15 from sliding along the sides 5 of the support frame 4 and to provide for equidistant placement. Additionally, for cover frames 11 of substantially the same size and shape as the support frame 4, as shown in FIG. 2, the placement of the hooks 15 at each corner 6 of the support frame 4 further acts to lock the cover frame 11 and the rim 2 of the bag 1 in place on top of the support frame 4 since the corresponding corners of the support frame 4 and cover frame 11 each penetrate through the plane of the hook 15 and are locked in by the central curvilinear portion 16 of the hooks 15. It is noted, however, that the engagement members can comprise other fastening structures, such as clamps, tie downs, screws, bolts, etc., and can further be coupled to either the top or outer edge of each side 5 to secure the support frame 4 in a suspendable state.

With respect to fastening the rim 2 of the bag 1 to the apparatus for suspension therefrom, the present invention provides several methods for safely securing the bag 1 so that it does not easily tear or loosen. In one embodiment of the present invention (not shown), the rim 2 of the bag 1 is simply secured about the sides 5 of the support frame 4 (with or without first inserting the rim through the first aperture) by use of upward protrusions, clamp members, fasteners, hooks or the like provided on each side 5 of the support frame 4. In another embodiment, shown in FIGS. 1 and 2, the respective rim portions 2 of the bag 1 are wrapped completely around each side 5 of the support frame 4 where the engagement members can then be secured underneath to hold the rim 2 of the bag 1 against the support frame 4 at a plurality of points. In a further embodiment, shown in FIG. 2, a cover frame 11 corresponding to the size and shape of the support frame 4 can be disposed thereon such that the rim 2 is interposed between the two frames 4,11. In this manner, the locking engagement of the engagement members forces the cover frame 11 down onto the support frame 4, thereby clamping the rim 2 of the bag 1 therebetween. Obviously, the manner in which the bag 1 is secured to the support frame 4 for suspension therefrom in an open state is not limited to these embodiments and can further comprise a combination of the described methods (see FIG. 2).

Now that the bag 1 is firmly secured to the support frame 4, the support frame 4 itself must be coupled to a support structure such as a tree, a beam, a rope, a wall, an overhang, etc. in order to suspend the bag 1 above the ground. For this purpose, the apparatus is provided with a plurality of suspension arms 19 having a first end 20 adapted with a hook, a loop, a fastener or the like for attachment to the engagement members and a second end 21 again adapted with a hook, a loop, a fastener or the like for attachment to the support structure. Additionally, an upholding means 22 can be provided to act as a mutual connection between the suspension arms 19 and the support structure, the upholding means comprising a coupling member such as a bracket, a clamp, a clip, a cord (FIG. 2), a loop or a hook (FIG. 1). Through the use of the upholding means 22, the suspension arms 19 of the apparatus can be drawn inward to improve the locking engagement between the engagement members, the support frame 4, the rim 2 of the bag 1 and the cover frame 11, in addition to providing an equidistant connection point for level suspension of the top surfaces 7,12 of the frames 4,11. Furthermore, either the upholding means 22 and/or the suspension arms 19 can be adapted with a length adjustment member 25 such as a locking telescopic joint or a double screw clamp for rigid bodies, a sliding clamp for a cord (shown in FIG. 2) or the like to enable adjustment of the apparatus' height and the particular inclination of the upper surfaces 7,12 of the frames 4,11.

With reference to FIG. 3, the suspension arms 19 are preferably formed in pairs with loops disposed at one end 20 of each arm 19 and a third loop disposed at a coupling between the other end 21 of the suspension arms 19 for attachment of the third loop to the upholding means 22. With this arrangement, the upholding means 22 would then comprise a corresponding S-hook or a hook with a fastener at one end for connection to the third loop of each pair of suspension arms 19. As would be obvious to one skilled in the art, the particular form of the upholding means 22 is dependent upon the selection of the support structure and the construction of the first end 20 of the suspension arms 19.

With the construction of the apparatus as herein described, the present invention can be utilized for a variety of purposes where a conventional trash bag 1 or trash can is cumbersome or impossible to use, does not provide an appropriate opening for the insertion of the items 3 or cannot be appropriately covered to reduce exposure of the items 3 to weather, children or animals. In this regard, the apparatus is particularly well-suited for picnicking, camping or other outdoor activities where food, trash and other items can be hung out of the reach of animals. In addition, the lightweight nature of the apparatus and the ease with which it can be suspended and securely closed further makes it advantageous for such activities.

While the invention has been described in conjunction with the various embodiments shown in the figures, it is evident that numerous alternatives, depictions, variations and uses will be apparent to those skilled in the art in light of the foregoing description. The apparatus of the present invention is not limited to the particular construction, shapes and sizes herein described or shown in the figures due to their dependence upon the use to which it is put. For example, the present invention can be constructed for use as a trash container for both normal trash and recyclable materials wherein the cover frame 11 can be adapted with two apertures and the support frame 4 includes a central longitudinal divider for the attachment of a trash bag 1 on each side corresponding to each aperture.

I claim:

1. An apparatus for the suspension of a bag from a support structure for suspendable storage of items held within the bag, the bag having a rim defining an opening of the bag, the apparatus comprising:

a support frame having a plurality of sides defining a plurality of corners formed by adjoining sides of the support frame, the support frame further having a top surface with an inner perimeter defined by a first aperture formed in the top surface, the rim of the bag being attached about the support frame in a plurality of locations to maintain the bag in an open position;

a plurality of engagement members for engaging and supporting the support frame each having two upturned ends for attachment to different adjoining sides of a corner of the support frame such that each corner is supported by an engagement member; and a plurality of suspension arms having first and second ends for attachment of the suspension arms between the engagement members and the support structure.

2. The apparatus of claim 1, wherein the sides of the support frame comprise telescopic joints to enable extension and contraction of the sides for adapting the size and shape of the support frame to fit a particular bag.

3. The apparatus of claim 1, wherein each engagement member comprises a hook having a central curvilinear portion formed substantially within a plane with the two upturned ends extending outward on one side of the plane for attachment to the adjoining sides of a corner such that the corner protrudes through the plane defined by the central curvilinear portion.

4. The apparatus of claim 1, wherein the apparatus further comprises a cover frame disposed on top of the support frame having a planar surface for covering the first aperture of the support frame and a second aperture formed in the planar surface for passage of the items into the bag.

5. The apparatus of claim 4, wherein the rim of the bag is inserted through the first aperture of the support frame such that the bag is received about the inner perimeter, the rim being interposed between the cover frame and the support frame.

6. The apparatus of claim 5, wherein the rim of the bag is further wrapped around the support frame for engagement of the rim by the engagement members about the support frame.

7. The apparatus of claim 4, wherein the apparatus further comprises a lid disposed on top of the cover frame for covering the second aperture of the cover frame.

8. The apparatus of claim 3, wherein the apparatus further comprises a cover frame having a plurality of sides defining a plurality of corners corresponding to the sides and corners of the support frame such that the corners of the cover frame protrude through the plane defined by the central curvilinear portion of the hooks to secure the cover frame on top of the support frame.

9. The apparatus of claim 1, wherein the apparatus further comprises upholding means for coupling the second ends of the suspension arms together and engaging the support structure for suspension of the apparatus, the upholding means comprising a coupling member selected from the group consisting of cord, a hook, an eyelet, a bracket, a clamp and a clip.

10. An apparatus for the suspension of a bag from a support structure for suspendable storage of items held within the bag, the bag having a rim defining an opening of the bag, the apparatus comprising:

a support frame having a top surface with an inner perimeter defined by a first aperture formed in the top surface, the rim of the bag being attached about the support frame in a plurality of locations to maintain the bag in an open position;

a plurality of hook-like engagement members for engaging and supporting both the rim of the bag and the support frame from underneath the support frame, the engagement members securing the rim of the bag to the support frame by the gravitational force exerted by the support frame on the engagement members; and a plurality of suspension arms having first and second ends for attachment of the suspension arms between the engagement members and the support structure such that the support frame hangs from the suspension arms at the points of engagement with the engagement members.

11. An apparatus for the suspension of a bag from a support structure for suspendable storage of items held within the bag, the bag having a rim defining an opening of the bag, the apparatus comprising:

a support frame having a plurality of sides defining a plurality of corners formed by adjoining sides of the support frame and a top surface with an inner perimeter defined by a first aperture formed in the top surface, the rim of the bag being attached about the support frame in a plurality of locations to maintain the bag in an open position;

a cover frame disposed on top of the support frame having a planar surface for covering the first aperture of the support frame and a second aperture formed in the planar surface for passage of the items into the bag;

a lid disposed on top of the cover frame for covering and closing the second aperture of the cover frame;

a plurality of engagement members for corresponding engagement with the corners of the support frame, each engagement member having two upturned ends for attachment to different adjoining sides of a corner such that the each corner is supported by an engagement member; and a plurality of suspension arms having first and second ends for attachment of the suspension arms between the engagement members and the support structure.

12. The apparatus of claim 11, wherein each engagement member comprises a hook having a central curvilinear portion formed within a plane with the two upturned ends extending outward on one side of the plane for attachment to the adjoining sides of a corner such that the corners of the support frame protrude through the plane defined by the central curvilinear portion.

13. The apparatus of claim 11, wherein the rim of the bag is inserted through the first aperture of the support frame such that the bag is received about the inner perimeter, the rim being interposed between the cover frame and the support frame.

14. The apparatus of claim 13, wherein the rim of the bag is further wrapped around the sides of the support frame for engagement of the rim by the upturned ends of the engagement members.

15. The apparatus of claim 12, wherein the cover frame comprises a plurality of sides defining a plurality of corners corresponding to the sides and corners of the support frame, the cover frame disposed on top of the support frame in a corresponding arrangement such that the corners of the cover frame protrude through the plane defined by the central curvilinear portion of the hooks to hold the cover frame in place.

16. The apparatus of claim 11, wherein the apparatus further comprises upholding means for coupling the second ends of the suspension arms together and engaging the support structure for suspension of the apparatus, the upholding means comprising a coupling member selected from the group consisting of cord, a hook, an eyelet, a bracket, a clamp and a clip.

17. The apparatus of claim 11, wherein the sides of the support frame comprise telescopic joints to enable extension and contraction of the sides for adapting the size and shape of the support frame to fit a particular bag.

18. An apparatus for the suspension of a bag from a support structure for suspendable storage of items held within the bag, the bag having a rim defining an opening of the bag, the apparatus comprising:

a support frame having a plurality of sides defining a plurality of corners and a top surface with an inner perimeter defined by a first aperture formed in the top surface, the rim of the bag inserted through the first aperture and overlapping the sides of the cover frame such that the bag is received about the inner perimeter and opens through the first aperture;

a cover frame having a planar surface with a second aperture formed in the planar surface for passage of the items into the bag, the cover frame disposed on top of the support frame with the rim of the bag interposed between the support frame and the cover frame;

a lid disposed on top of the cover frame for covering the second aperture of the cover frame;

a plurality of engagement hooks for engagement with the corners of the support frame, each engagement hook having a central curvilinear portion formed within a plane and two upturned ends extending outward on one side of the plane, each upturned end of each engagement hook engaging a different side of the support frame including the overlapping rim of the bag such that the corners of the support frame protrude through the plane defined by the central curvilinear portion; and a plurality of suspension arms having first and second ends for attachment of the suspension arms between the engagement members and the support structure.

19. The apparatus of claim 18, wherein the apparatus further comprises upholding means for coupling the second ends of the suspension arms together and engaging the support structure for suspension of the apparatus, the upholding means comprising a coupling member selected from the group consisting of cord, a hook, an eyelet, a bracket, a clamp and a clip.

20. The apparatus of claim 18, wherein the sides of the support frame comprise telescopic joints to enable extension and contraction of the sides for adapting the size and shape of the support frame to fit a particular bag.

* * * * *